US008664876B2

(12) United States Patent
Yang

(10) Patent No.: US 8,664,876 B2
(45) **Date of Patent: *Mar. 4, 2014**

(54) LIGHTING DEVICE WITH OPTICAL PULSATION SUPPRESSION BY POLYPHASE-DRIVEN ELECTRIC ENERGY

(76) Inventor: Tai-Her Yang, Dzan-Hwa (TW)

( * ) Notice: Subject to any disclaimer, the term of this patent is extended or adjusted under 35 U.S.C. 154(b) by 1208 days.

This patent is subject to a terminal disclaimer.

(21) Appl. No.: 12/457,998

(22) Filed: Jun. 29, 2009

(65) Prior Publication Data

US 2010/0327762 A1 Dec. 30, 2010

(51) Int. Cl.
*H05B 37/02* (2006.01)

(52) U.S. Cl.
USPC ..... 315/228; 315/250; 315/294

(58) Field of Classification Search
USPC ..... 315/137–148, 228, 250, 258, 294
See application file for complete search history.

(56) References Cited

U.S. PATENT DOCUMENTS

| | | | | |
|---|---|---|---|---|
| 2,265,323 | A * | 12/1941 | Spanner | 315/266 |
| 2,354,654 | A * | 8/1944 | Abbott | 315/138 |
| 3,787,751 | A * | 1/1974 | Farrow | 315/137 |
| 3,789,211 | A * | 1/1974 | Kramer | 315/185 S |
| 4,084,217 | A * | 4/1978 | Brandli et al. | 315/176 |
| 4,369,490 | A * | 1/1983 | Blum | 363/48 |
| 6,385,057 | B1 * | 5/2002 | Barron | 363/17 |
| 8,049,709 | B2 * | 11/2011 | Roberts et al. | 345/102 |
| 2007/0090767 | A1 * | 4/2007 | Roberts | 315/139 |
| 2007/0133230 | A1 * | 6/2007 | Lin | 363/1 |
| 2008/0130335 | A1 * | 6/2008 | Yuzurihara et al. | 363/125 |

* cited by examiner

*Primary Examiner* — Jimmy Vu
(74) *Attorney, Agent, or Firm* — Bacon & Thomas, PLLC

(57) ABSTRACT

Polyphase alternating current power with a phase difference, or direct current power rectified from polyphase alternating current power, is used to drive a common electric energy-driven luminous body, or to separately drive proximately installed individual electric energy-driven luminous bodies, so that alternating-current-induced pulsation in the light output of the luminous bodies is reduced.

13 Claims, 8 Drawing Sheets

LIGHTING DEVICE WITH OPTICAL PULSATION SUPPRESSION BY POLYPHASE-DRIVEN ELECTRIC ENERGY

BACKGROUND OF THE INVENTION (a) Field of the Invention

The present invention relates to a method of reducing pulsation or changes in brightness of an electric energy-driven luminous body resulting from the pulsation rate of an alternating current power voltage, by using polyphase-drive electric energy to reduce the pulsations.

(b) Description of the Prior Art

The deficiency of traditional alternating current lamps lies in their discontinuous optical pulsation caused by alternating current power pulsation.

SUMMARY OF THE INVENTION

The present invention relies on polyphase alternating current power or direct current power rectified from polyphase alternating current power to drive a common electric energy-driven luminous body; or to separately drive proximately installed individual electric energy-driven luminous bodies, so as to reduce alternating current-induced pulsation of the light output of the luminous body or bodies is reduced.

DESCRIPTION OF MAIN COMPONENT SYMBOLS (101) 、(102) 、(103): Electric energy-driven luminous body (1000): Inductive impedance devices (1011) 、(1012) 、(1021) 、(1022) 、(1031) 、(1032) 、(2011) 、(2012) 、(3011) 、(3012): Conductive terminals (2000): Direct current electric energy-driven luminous body (201): Capacitor (3000): Three-phase bridge rectifier (301): Inductor (3500): Three-phase half wave rectifier (401): Resistor (703) 、(704): Rectifier diodes (802) 、(803) 、(804): Single phase bridge rectifiers a: Alternating Current power wave form b: Wave-form of direct current rectified from alternating current c: Optical pulsation wave form of electric energy-driven luminous body (I101) ` (I102) ` (I103): Current N: Neutral line R ` S ` T: Three-phase alternating current power lines (Z10): Current limiting device (Z11): Half wave current limiting impedance device

DETAILED DESCRIPTION OF THE PREFERRED EMBODIMENTS

The deficiency of traditional alternating current lamps lies in their discontinuous pulsating light output caused by alternating current power pulsation.

The present invention relies on polyphase alternating current power with phase difference or direct current power rectified from polyphase alternating current power to drive a common electric energy-driven luminous body; or to separately drive proximately installed individual electric energy-driven luminous bodies, so that pulsation of the light output by the luminous body or bodies is reduced.

Figure 1:
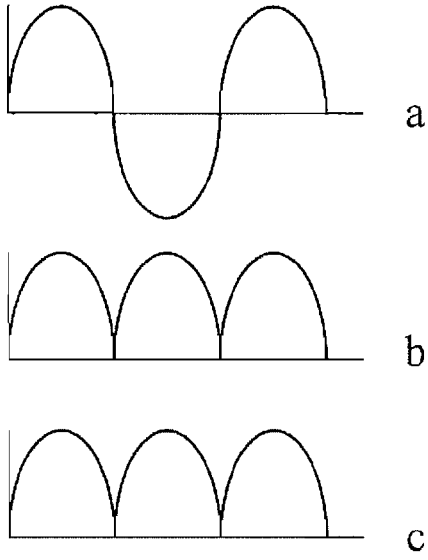
FIG. 1 (PRIOR ART)
FIG. 1 are waveform diagrams of a traditional single phase alternating current power or alternating current full wave-rectified direct current directly driving an electric energy-driven luminous body.

FIG. 1 is a waveform diagram of the optical pulsation resulting from use of traditional single phase alternating current power or full wave-rectified direct current to directly drive an electric energy-driven luminous body.

As shown in FIG. 1: a is an alternating current power wave-form; b is a wave-form of direct current rectified from alternating current; c is an optical pulsation wave-form of an electric energy-driven luminous body. If the electric energy input is a bidirectional pulsating electric energy with a bidirectional non-sinusoidal wave, the result is the same.

Figure 2:
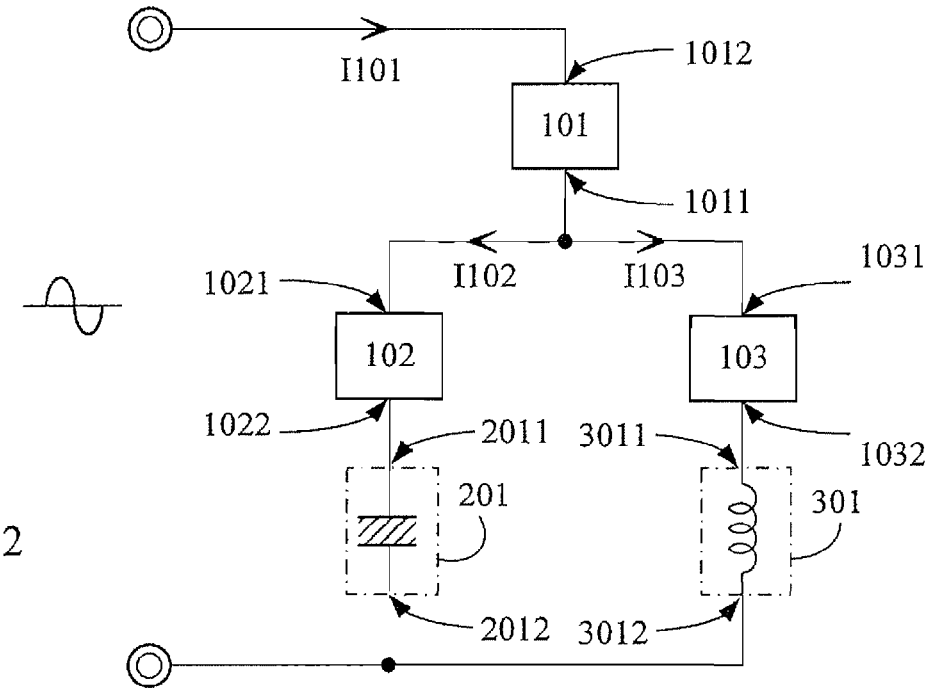
FIG. 2 is a circuit diagram of an electric energy-driven luminous body individually driven by single phase power in three ways through an inductor split-phase current, a capacitor split-phase current, and a resultant vector current of inductor and capacitor split-phase currents.

FIG. 2 is a circuit diagram of an electric energy-driven luminous body individually driven by single phase power in three ways through inductor split-phase current, capacitor split-phase current or the resultant vector current of inductor and capacitor split-phase currents.

As shown in FIG. 2, the components of the preferred circuit are arranged as follows:

The terminals (1011), (1021), and (1031) of the electric energy-driven luminous bodies (101), (102) and (103) driven by bidirectional electric energy are connected together. Terminal (1022) of the electric energy-driven luminous body (102) is connected to terminal (2011) of capacitor (201). Terminal (1032) of electric energy-driven luminous body (103) is connected to terminal (3011) of the inductor (301). Terminal (2012) of the capacitor (201) is connected to terminal (3012) of the inductor (301), and then to a terminal of an alternating current or bidirectional electric energy source. Terminal (1012) of electric energy-driven luminous body (101) is connected to the other terminal of the alternating current or bidirectional electric energy source, such that the current (I101) that passes through electric energy-driven luminous body (101) is the vector sum of the current (I102) that passes through electric energy-driven luminous body (102) and the current (I103) of electric energy-driven luminous body (103), which is also the total current.

Electric energy-driven luminous bodies (101), (102), (103) may take the form of three luminous bodies integrated into one body or three proximately installed bodies consisting of gas bulbs with filaments, solid state electric energy luminous bodies such as LEDs, and other luminous bodies that accept electric energy drive.

Figure 3:
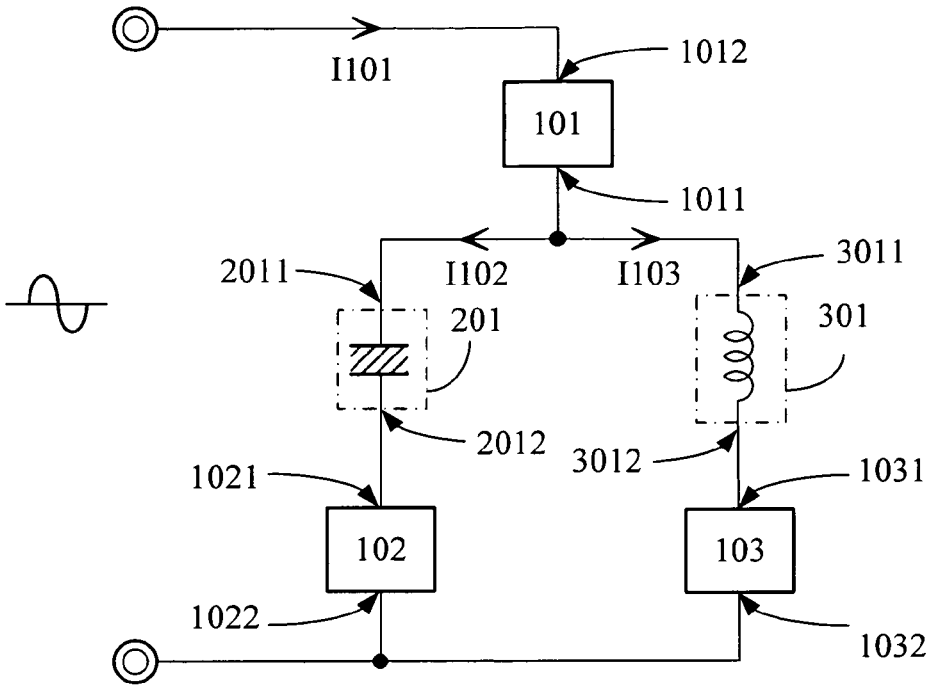
FIG. 3 is a circuit diagram showing interchanging positions of a capacitor and/or inductor with respect to the electric energy-driven luminous body of FIG. 2.

FIG. 3 is a circuit diagram showing interchanging positions of capacitor (201) with respect to electric energy-driven luminous body (102) and/or inductor (301) with respect to electric energy-driven luminous body (103) in FIG. 2, wherein:

Terminal (1011) of electric energy-driven luminous body (101), terminal (2011) of capacitor (201) and terminal (3011) of inductor (301) are connected together. The other terminal (2012) of capacitor (201) is connected to terminal (1021) of electric energy-driven luminous body (102). The other terminal (3012) of the inductor (301) is connected to terminal (1031) of the electric energy-driven luminous body (103). The other terminal (1022) of electric energy-driven luminous body (102) is connected to terminal (1032) of the electric energy-driven luminous body (103), and then to a terminal of a power source. The other terminal (1012) of the electric energy-driven luminous body (101) is connected to the other terminal of the power source;

Electric energy-driven luminous bodies (101), (102), (103) may include three luminous bodies integrated into one body or three proximately installed bodies consisting of gas bulbs with filaments, solid state electric energy luminous bodies such as LEDs, and other luminous bodies that accept electric energy drive;

Moreover, if series capacitor (201) or one of the electric energy-driven luminous bodies of inductor (301) is directly connected in parallel with electric energy-driven luminous body (101), or in parallel with the electric energy-driven luminous body (101) of the series resistor, then the pulsation of the projected light energy is also improved.

Figure 4:
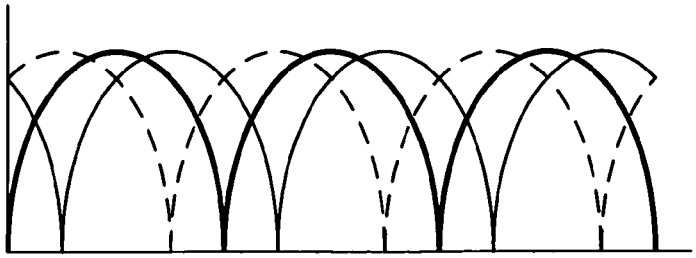
FIG. 4 is a diagram showing brightness variations of an electric energy-driven luminous body in FIG. 2 and FIG. 3.

FIG. 4 is a diagram of the brightness of the electric energy-driven luminous bodies in FIG. 2 and FIG. 3, showing a significant reduction in their luminous pulsation.

Figure 5:
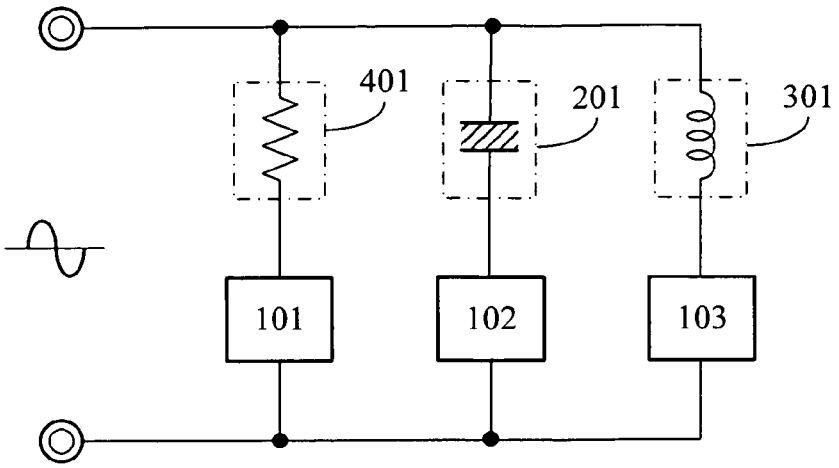
FIG. 5 is a circuit block diagram of the present invention in which impedances and electric energy-driven luminous bodies are connected in parallel with the alternating current power source in three ways: a capacitor is in series with an electric energy-driven luminous body, an inductor is in series with an electric energy-driven luminous body, and a resistor is in series with a electric energy-driven luminous body.

FIG. 5 is a circuit block diagram of an embodiment of the present invention, wherein the alternating current power is in parallel with: the capacitor (201) in series with the electric energy-driven luminous body (102), the inductor (301) in series with the electric energy-driven luminous body (103), and the resistor (401) in series with the electric energy-driven luminous body (101).

Figure 6:
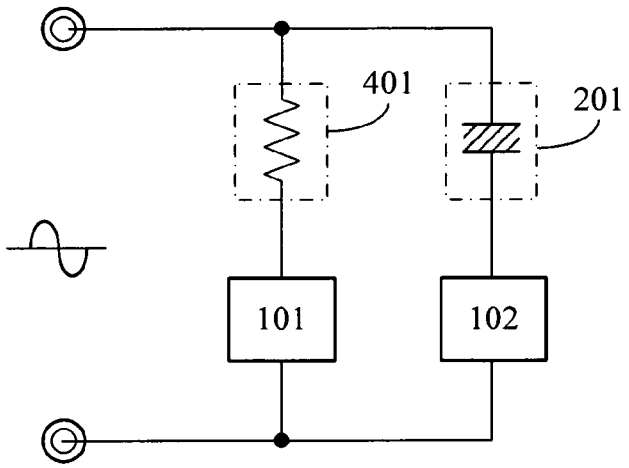
FIG. 6 is a circuit block diagram showing a capacitor in series with an electric energy-driven luminous body and connected in parallel directly with the electric energy-driven luminous body and another electric energy-driven luminous body in series with a resistor in order to accept alternating current or bidirectional power drive.

FIG. 6 is a circuit block diagram of an embodiment of the present invention showing a capacitor (201) in series with the electric energy-driven luminous body (102) and connected in parallel directly with the electric energy-driven luminous body (101), or with the electric energy-driven luminous body (101) in series with the resistor (401), in order to accept alternating current or bidirectional power drive.

Figure 7:
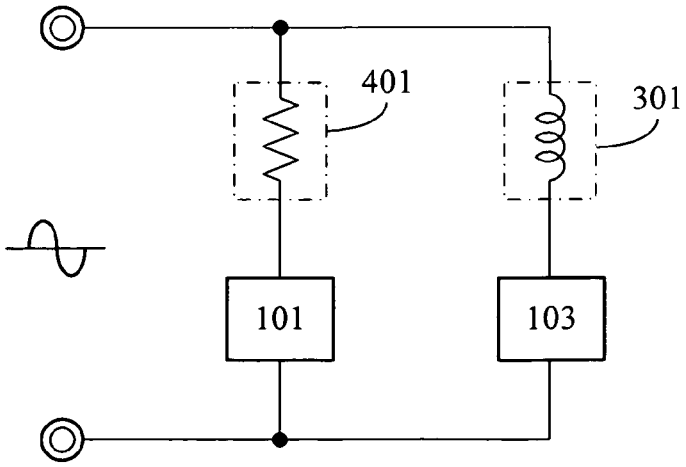
FIG. 7 is a circuit block diagram showing an inductor in series with an electric energy-driven luminous body and connected in parallel directly with the electric energy-driven luminous body or with the electric energy-driven luminous body in series with the resistor in order to accept alternating current or bidirectional power drive.

FIG. 7 is a circuit block diagram of an embodiment of the present invention showing an inductor (301) in series with the electric energy-driven luminous body (103) and connected in parallel directly with the electric energy-driven luminous body (101), or with the electric energy-driven luminous body (101) in series with the resistor (401), in order to accept alternating current or bidirectional power drive.

Figure 8:
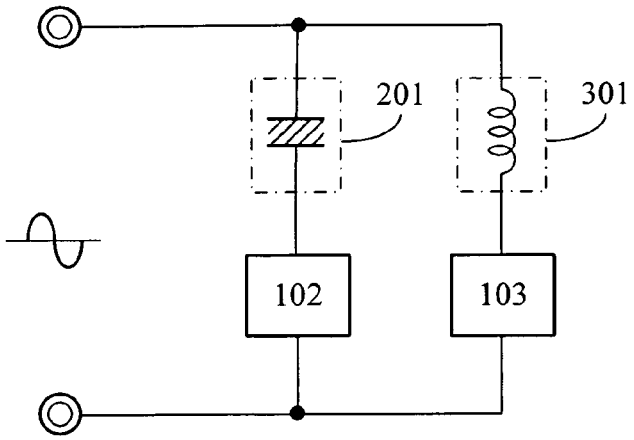
FIG. 8 is a circuit block diagram showing a capacitor in series with an electric energy-driven luminous body and connected in parallel with the electric energy-driven luminous body in series with the inductor in order to accept alternating current or bidirectional power drive.

FIG. 8 is a circuit block diagram of the present invention showing a capacitor (201) in series with the electric energy-driven luminous body (102) and connected in parallel with the electric energy-driven luminous body (103) in series with the inductor (301), in order to accept alternating current or bidirectional power drive.

The lighting device with pulsation suppression by polyphase-driven electric energy may employ three-phase alternating current power to supply electricity to the electric energy-driven luminous body to minimize the pulsation of the luminous brightness.

Figure 9:
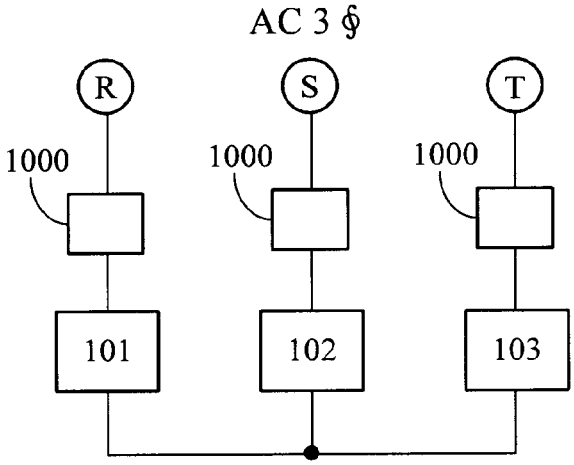
FIG. 9 is a circuit diagram of an embodiment of the present invention in which three-phase, four wire alternating current power is drives three sets of electric energy-driven luminous bodies in Y connection.

FIG. 9 is a circuit diagram of the present invention wherein three-phase, four wire alternating current power drives three sets of electric energy-driven luminous bodies in Y connection, using the following circuit arrangement:

Electric energy-driven luminous body (101) is directly connected or in series with the resistive and/or capacitive and/or inductive impedance device (1000), after which one terminal connects to a three-phase power line R, while the other terminal goes to a common Y connection point.

Electric energy-driven luminous body (102) is directly connected or in series with the resistive and/or capacitive and/or inductive impedance device (1000) after which one terminal connects to a three-phase power line S-, while the other terminal goes to a common Y connection point.

Electric energy-driven luminous body (103) is directly connected or in series with the resistive and/or capacitive and/or inductive impedance device (1000), after which one terminal connects to a three-phase power line T-, while the other terminal goes to a common Y connection point.

Figure 10:
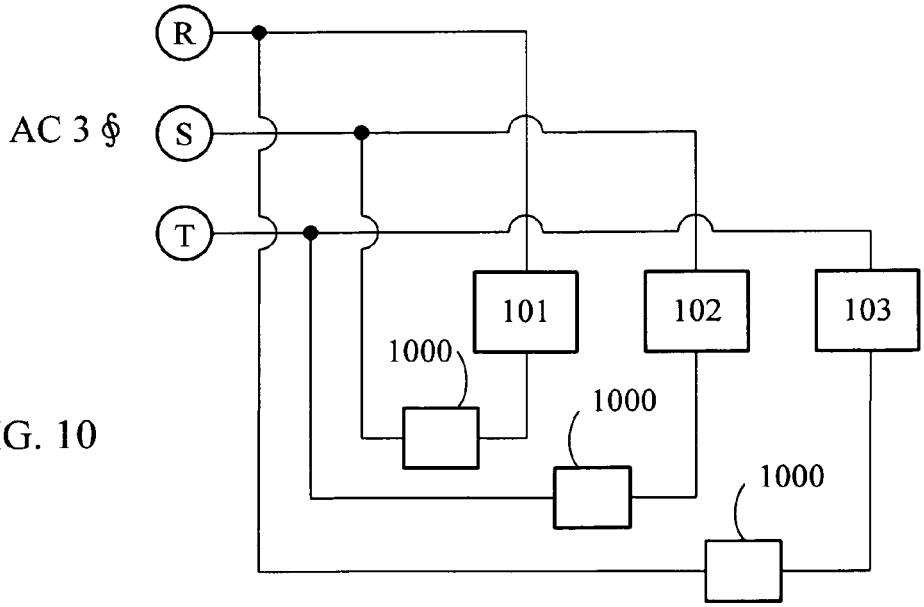
FIG. 10 is a circuit diagram of an embodiment of the present invention in which three-phase alternating current power drives three sets of electric energy-driven luminous bodies in Δ connection.

FIG. 10 is a circuit diagram of the present invention wherein three-phase alternating current power drives three sets of electric energy-driven luminous bodies in Δ connection. As shown in FIG. 10, this circuit is arranged as follows:

Electric energy-driven luminous body (101) is directly connected or in series with the resistive and/or capacitive and/or inductive impedance device (1000), and then in parallel between power line R and power line S.

Electric energy-driven luminous body (102) is directly connected or in series with the resistive and/or capacitive and/or inductive impedance device (1000), and then in parallel between power line S and power line T.

Electric energy-driven luminous body (103) is directly connected or in series with the resistive and/or capacitive and/or inductive impedance device (1000), and then in parallel between power line T and power line R.

Figure 11:
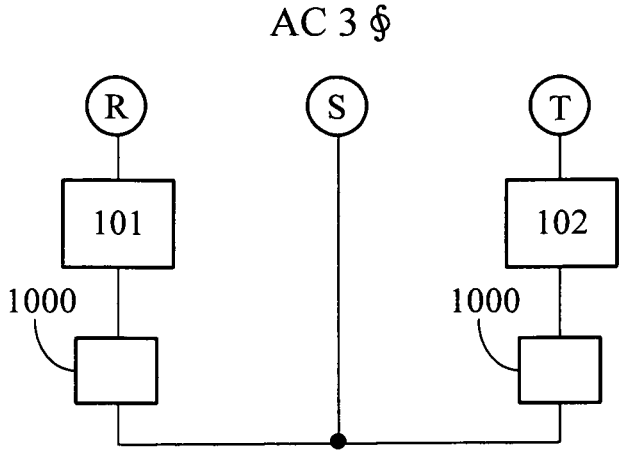
FIG. 11 is a first circuit diagram of an embodiment of the present invention in which three-phase alternating current power drives two sets of electric energy-driven luminous bodies in V connection.

FIG. 11 is a first circuit diagram of an embodiment of the present invention in which three-phase alternating current power is used to drive two sets of electric energy-driven luminous bodies in V connection, as follows:

Electric energy-driven luminous body (101) is directly connected or in series with the resistive and/or capacitive and/or inductive impedance device (1000), and then in parallel between power line R and power line S.

Electric energy-driven luminous body (102) is directly connected or in series with the resistive and/or capacitive and/or inductive impedance device (1000), and then in parallel between power line S and power line T.

Figure 12:
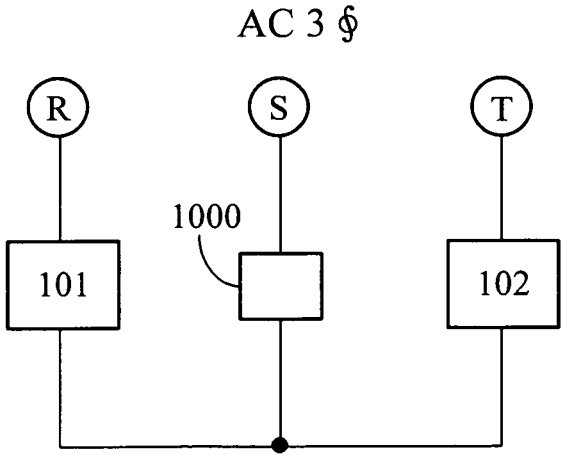
FIG. 12 is a second circuit diagram of an embodiment of the present invention in which three-phase alternating current power drives two sets of electric energy-driven luminous bodies in V connection.

FIG. 12 is a second circuit diagram of the embodiment of the present invention in which three-phase alternating current power drives two sets of electric energy-driven luminous bodies in V connection, as follows:

Electric energy-driven luminous body (101) is connected in series with electric energy-driven luminous body (102), and then in parallel between power line R and power line T;

The power line S, after connecting in series with a resistive and/or capacitive and/or inductive impedance device (1000), is then connected to the series connection point of electric energy-driven luminous body (101) and electric energy-driven luminous body (102).

The lighting device with optical pulsation suppression by polyphase-driven electric energy further may rely on direct current power rectified from polyphase alternating current power to drive a common electric energy-driven luminous body; or to separately drive proximately installed individual electric energy-driven luminous bodies so that the pulsation of the outwardly projected light is reduced.

Figure 13:
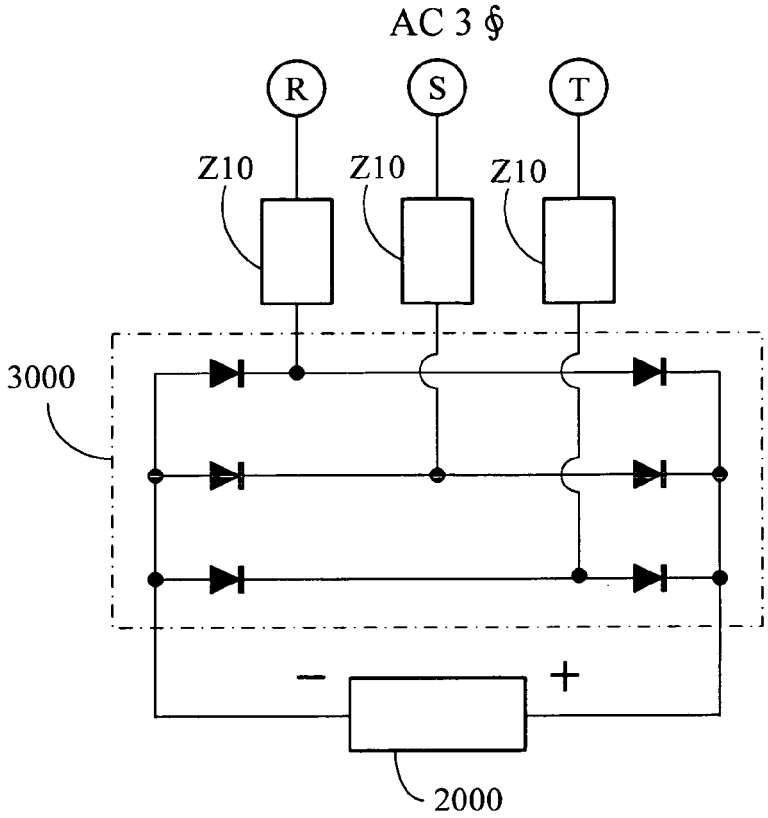
FIG. 13 is a circuit diagram showing three-phase alternating current power being supplied, through current limiting devices, to a three phase full wave direct current electric energy that had been rectified by a bridge rectifier and then supplied to a direct current electric energy-driven luminous body.

FIG. 13 is a circuit diagram showing three-phase alternating current power supplied, through the current limit device (Z10), from a three-phase full wave direct current electric energy source that is rectified by a bridge rectifier so as to supply direct current electric energy-driven luminous body (2000).

As shown in FIG. 13, this circuit is arranged as follows:

The input terminals for three-phase alternating current power, -R, S, and T, of the three-phase bridge rectifier (3000) are separately connected in series with the current limiting impedance device (Z10) and then connected to the three-phase alternating current power source. Current limiting device (Z10) includes resistor (401) and/or inductor (301) and/or capacitor (201). The direct current electric energy from the direct current output terminal is supplied to the direct current electric energy-driven luminous body (2000).

Electric energy-driven luminous body (2000) may include gas bulbs with filaments, solid state electric energy luminous bodies such as an LED, and other luminous bodies that accept direct current electric energy drive.

Figure 14:
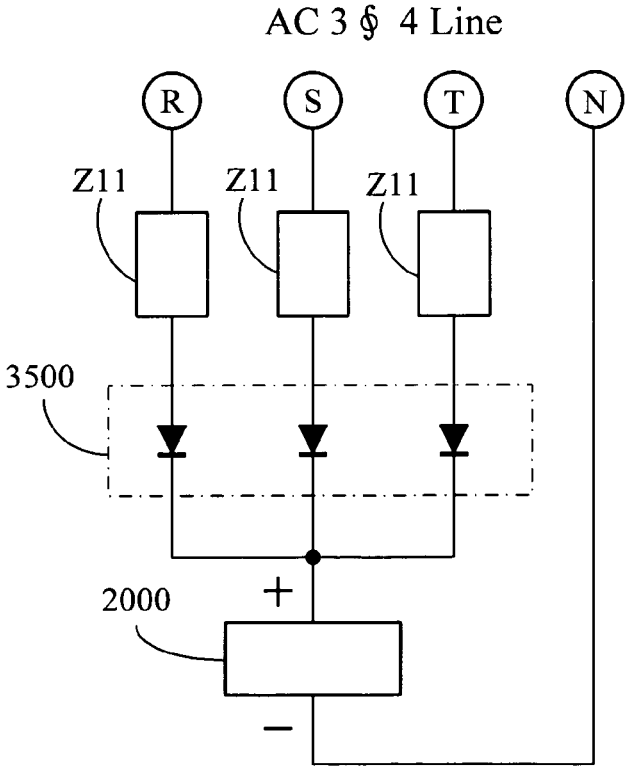
FIG. 14 is a circuit diagram showing three-phase alternating current power passing through a half-wave current-limiting impedance device to a three-phase half-wave rectifier, the rectified direct current electric energy being delivered to a direct current electric energy-driven luminous body.

FIG. 14 is a circuit diagram showing three-phase alternating current power passing through a half-wave current limiting impedance device (Z11) to a three phase half-wave rectifier (3500), with the rectified direct current electric energy being supplied to the direct current electric energy-driven luminous body (2000).

As shown in FIG. 14, this circuit is arranged as follows:

The input terminals for three-phase alternating current power, -R, S, and T, of the three-phase half wave rectifier (3500) are separately connected in series with the half wave current limiting impedance device (Z11) and then connected to the three-phase alternating current power source. Half wave current limiting impedance device (Z11) may include resistor (401) and/or inductor (301) and/or capacitor (201). The direct current electric energy from the direct current output terminal of the three-phase half wave rectifier (3500) is supplied to the direct current electric energy-driven luminous body (2000), while the negative terminal of the direct current electric energy-driven luminous body connects to the neutral line N of the three-phase, four wire power source.

Direct current electric energy-driven luminous body (2000) may include one or more gas bulbs with filaments, solid state electric energy luminous bodies such as LEDs, and other luminous bodies that accept direct current electric energy drive;

Moreover, single phase alternating current power may be used from at least two of the following: (1) output electric energy from the series connection between the single alternating current power and resistor (401), (2) output electric energy from the series connection between the same single phase alternating current power and capacitor (201), and (3) electric energy from the series connection between the same alternating current power and the inductor (301). After being rectified by separate rectifiers, the single phase power from at least two of the above arrangements may be used to jointly drive the direct current electric energy-driven luminous body (2000) in order to reduce pulsation of the light output of the luminous body (2000).

Figure 15:
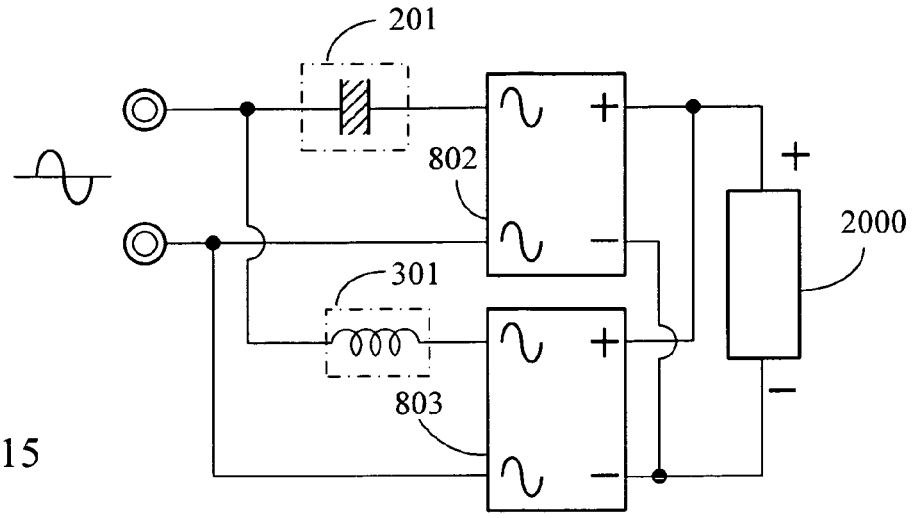
FIG. 15 is a circuit diagram of a capacitor and inductor effecting split phase and then full wave rectification on single phase power in order to drive a direct current electric energy-driven luminous body.

FIG. 15 is a circuit diagram of a capacitor and inductor effecting split phase and then full wave rectification on single phase power in order to drive a direct current electric energy-driven luminous body (2000).

As shown in FIG. 15, one terminal of the single phase alternating current power supply is connected to one of the alternating current input terminals of the single phase bridge rectifier (802) through capacitor (201). The same terminal from the same single phase alternating current power is also connected to one of the alternating current input terminals of another single phase bridge rectifier (803) through inductor (301). The other terminal of the single phase alternating current power supplies the other alternating current power input terminal of the single phase bridge rectifiers (802) and (803); and then the direct current output terminals of the single phase bridge rectifiers (802) and (803) are connected in parallel with the same polarity in order to drive the direct current electric energy-driven luminous body (2000).

Figure 16:
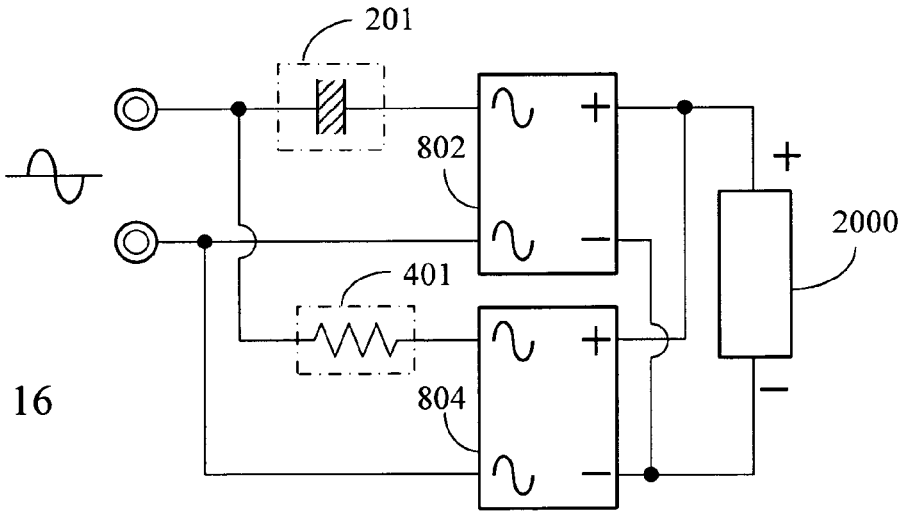
FIG. 16 is a circuit diagram of a capacitor and resistor effecting split phase and then full wave rectification on the single phase power in order to drive the direct current electric energy-driven luminous body.

FIG. 16 is a circuit diagram of a capacitor and resistor effecting split phase and then full wave rectification on single phase power in order to drive a direct current electric energy-driven luminous body (2000).

As shown in FIG. 16, one terminal of the single phase alternating current power is connected to one of the alternating current input terminals of the single phase bridge rectifier (802) through capacitor (201). The same terminal from the same single phase alternating current power is connected to one of the alternating current input terminals of another single phase bridge rectifier (804) through resistor (401). The other terminal of the single phase alternating current power supplies the other alternating current power input terminal of the single phase bridge rectifiers (802) and (804), and then the direct current output terminals of the single phase bridge rectifiers (802) and (804) are connected in parallel with a same polarity in order to drive the direct current electric energy-driven luminous body (2000).

Figure 17:
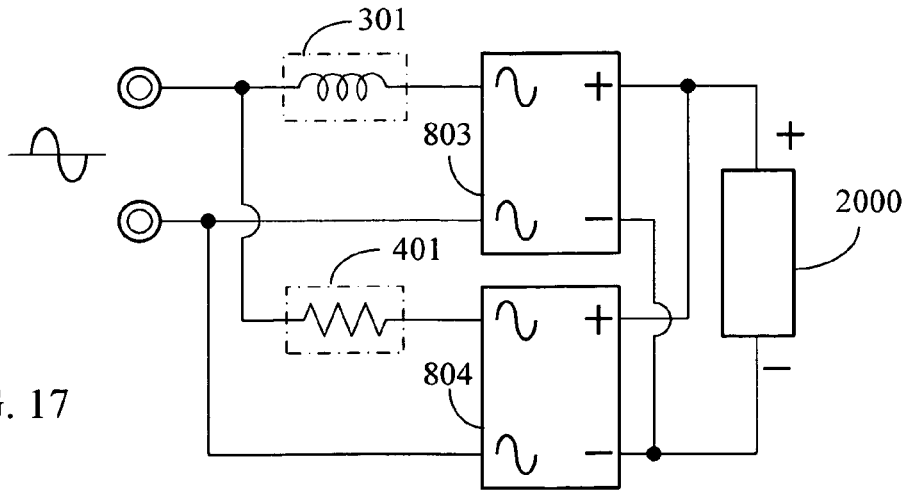
FIG. 17 is a circuit diagram of an inductor and resistor effecting split phase and then full wave rectification on single-phase power in order to drive a direct current electric energy-driven luminous body.

FIG. 17 is a circuit diagram of the inductor and resistor effecting split phase and then full wave rectification on single phase power in order to drive the direct current electric energy-driven luminous body (2000).

As shown in FIG. 17, one terminal of the single phase alternating current power is connected to one of the alternating current input terminals of the single phase bridge rectifier (803) through inductor (301). The same terminal from the same single phase alternating current power is connected to one of the alternating current input terminals of another single phase bridge rectifier (804) through resistor (401). The other terminal of the single phase alternating current power supplies the other alternating current power input terminal of the single phase bridge rectifiers (803) and (804). Then, the direct current output terminals of the single phase bridge rectifiers (803) and (804) are connected in parallel with a same polarity in order to drive the direct current electric energy-driven luminous body (2000).

Figure 18:
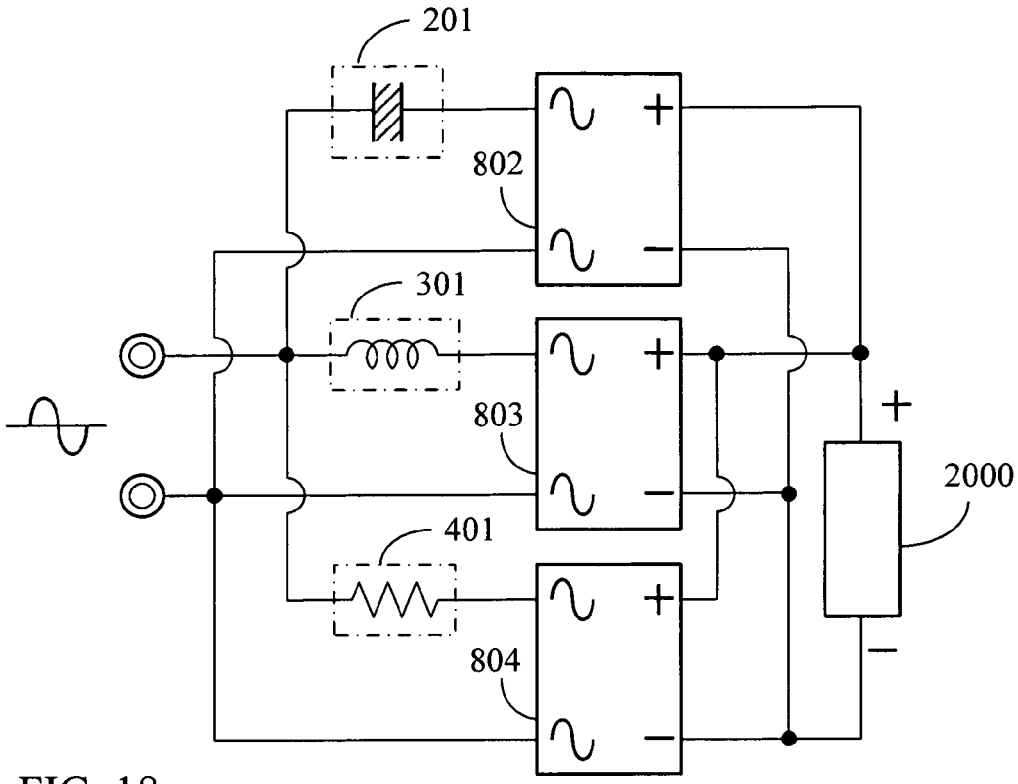
FIG. 18 is a circuit diagram of an inductor, resistor and capacitor effecting split phase and then full wave rectification on a single-phase power in order to drive a direct current electric energy-driven luminous body.

FIG. 18 is an circuit diagram of the inductor, resistor and capacitor effecting split phase and then full wave rectification on the single phase power in order to drive a direct current electric energy-driven luminous body (2000).

As shown in FIG. 18, one terminal of the single phase alternating current power is connected to one of the alternating current input terminals of the single phase bridge rectifier (803) through inductor (301). The same terminal from the same single phase alternating current power is connected to one of the alternating current input terminals of another single phase bridge rectifier (804) through resistor (401). The same terminal of the same single phase alternating current power is connected to one of the alternating input terminals of another single phase bridge rectifier (802) through capacitor (201). The other terminal of the single phase alternating current power supplies the other alternating current power input terminal of the single phase bridge rectifiers (802), (803) and (804); and then the direct current output terminals of the single phase bridge rectifiers (802), (803) and (804) are connected in parallel with a same polarity in order to drive the direct current electric energy-driven luminous body (2000).

Figure 19:
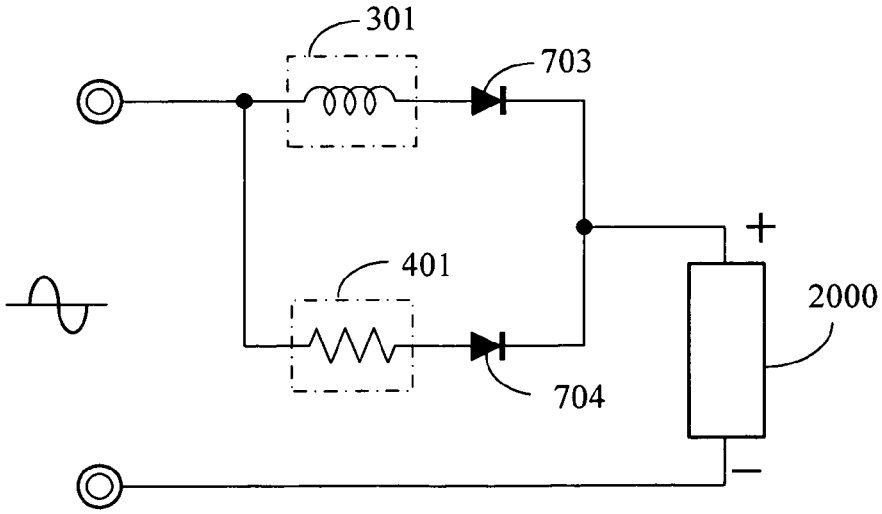
FIG. 19 is a circuit diagram of an inductor and resistor effecting split phase and then half wave rectification on single-phase power in order to drive a direct current electric energy-driven luminous body.

FIG. 19 is a circuit diagram of an inductor and resistor effecting split phase and then half wave rectification on the single phase power in order to drive a direct current electric energy-driven luminous body (2000).

As shown in FIG. 19, one terminal of the single phase alternating current power is connected to the alternating current input terminals of the rectifier diode (703) through inductor (301). The same terminal from the same single phase alternating current power is connected to one of the alternating current input terminals of another rectifier diode (704) through resistor (401). The other terminal of the single phase alternating current power is connected to the negative terminal of the direct current electric energy-driven luminous body (2000). Then, the direct current output positive terminals of the rectifier diodes (703) and (704) are connected in parallel with a same polarity in order to drive the direct current electric energy-driven luminous body (2000).

The invention claimed is:

1. A lighting device with optical pulsation suppression by polyphase-driven electric energy, said lighting device being supplied with electric power from a three-phase, three wire, Y-connected, alternating current power line including a first wire (R), a second wire (S), a third wire (T), and a common Y connection point, comprising:

a first electric energy-driven luminous body (101) having a first terminal connected to the first wire (R) of the three-phase power line through a first impedance device (1000), and a second terminal connected to the common Y connection point;

a second electric energy-driven luminous body (102) having a first terminal connected to a second wire (S) of the three-phase power line through a second impedance device (1000), and a second terminal connected to the common Y connection point;

a third electric energy-driven luminous body (103) having a first terminal connected a third wire (T) of the three-phase power line through a third impedance device (1000), and a second terminal connected to the common Y connection point.

2. The lighting device with optical pulsation suppression by polyphase-driven electric energy as claimed in claim 1, wherein each said first, second, and third impedance devices includes at least one of a resistive impedance device, a capacitive impedance device, and a inductive impedance device.

3. A lighting device with optical pulsation suppression by polyphase-driven electric energy, said lighting device being supplied with electric power from a three-phase, Δ-connected, alternating current power line including a first wire (R), a second wire (S), and a third wire (T), comprising:

a first electric energy-driven luminous body (101) connected to a first impedance device (1000), said first electric energy-driven luminous body (101) and said first impedance device (1000) being together connected in parallel between the first wire (R) of the three-phase power line and the second wire (S) of the three-phase power line;

a second electric energy-driven luminous body (102) connected to a second impedance device (1000), said first electric energy-driven luminous body (102) and said second impedance device (1000) being together connected in parallel between the second wire (S) of the three-phase power line and the third wire (T) of the three-phase power line;

a third electric energy-driven luminous body (103) connected to a third impedance device (1000), said first electric energy-driven luminous body (103) and said third impedance device (1000) being together connected in parallel between the third wire (T) of the three-phase power line and the first wire (R) of the three-phase power line.

4. The lighting device with optical pulsation suppression by polyphase-driven electric energy as claimed in claim 3, wherein each of said first, second, and third impedance devices (1000) includes at least one of a resistive impedance device, a capacitive impedance device, and a inductive impedance device.

5. A lighting device with optical pulsation suppression by polyphase-driven electric energy, said lighting device being supplied with electric power from a three-phase, alternating current power line including a first wire (R), a second wire (S), and a third wire (T), comprising:

a first electric energy-driven luminous body (101) connected to a first impedance device (1000), said first electric energy-driven luminous body (101) and said first impedance device (1000) being together connected in parallel between the first wire (R) of the three-phase power line and the second wire (S) of the three-phase power line;

a second electric energy-driven luminous body (102) connected to a second impedance device (1000), said first electric energy-driven luminous body (102) and said second impedance device (1000) being together connected in parallel between the second wire (S) of the three-phase power line and the third wire (T) of the three-phase power line, said first and second electric energy-driven luminous bodies (101,102) forming a V connection with said first, second, and third wires (R,S,T) of the three phase power line.

6. The lighting device with optical pulsation suppression by polyphase-driven electric energy as claimed in claim 5, wherein each of said first and second impedance devices (1000) includes at least one of a resistive impedance device, a capacitive impedance device, and a inductive impedance device.

7. A lighting device with optical pulsation suppression by polyphase-driven electric energy, said lighting device being supplied with electric power from a three-phase, alternating current power line including a first wire (R), a second wire (S), and a third wire (T), comprising:

a first electric energy-driven luminous body (101) and a second electric energy-driven luminous body (102) connected in series between the first wire (R) of the three-phase power line and the third wire (T) of the three-phase power line, an impedance device (1000) connected between a series-connection point of the first and second electric energy-driven luminous bodies (101,102) and said second wire (S) of the three-phase power line to form a V connection between said first and second electric energy-driven luminous bodies (101,102) and said first, second, and third wires (R,S,T) of the three phase power line.

8. The lighting device with optical pulsation suppression by polyphase-driven electric energy as claimed in claim 7, wherein said impedance device (1000) includes at least one of a resistive impedance device, a capacitive impedance device, and a inductive impedance device.

9. A lighting device with optical pulsation suppression by polyphase-driven electric energy, said lighting device being supplied with electric power from a three-phase alternating current power line including a first wire (R), a second wire (S), a third wire (T), comprising:

a three-phase bridge rectifier (3000) having three input terminals;

first, second, and third impedance devices (Z10) respectively connected in series between the three input terminals of the three-phase bridge rectifier (3000) and the first, second, and third wires (R,S,T) of the three-phase power supply; and at least one direct current electric energy-driven luminous body (2000) connected between output terminals of the three-phase bridge rectifier (3000), wherein each said first, second, and third impedance device (Z10) includes at least one of a resistive impedance device and a capacitive impedance device.

10. The lighting device with optical pulsation suppression by polyphase-driven electric energy as claimed in claim 9, wherein said direct current electric energy-driven luminous body (2000) includes at least one of a gas bulb with a filament, a solid state luminous body, and a light emitting diode.

11. A lighting device with optical pulsation suppression by polyphase-driven electric energy, said lighting device being supplied with electric power from a three-phase, four wire, alternating current power line including a first wire (R), a second wire (S), a third wire (T), and a neutral wire (N), comprising:

a three-phase half-wave rectifier (3500) having three input terminals;

first, second, and third impedance devices (Z11) respectively connected in series between the three input terminals of the three-phase half-wave rectifier (3500) and the first, second, and third wires (R,S,T) of the three-phase power supply; and at least one direct current electric energy-driven luminous body (2000) connected between an output terminal of the three-phase half-wave rectifier (3500) and the neutral wire (N).

12. The lighting device with optical pulsation suppression by polyphase-driven electric energy as claimed in claim 11, wherein each said first, second, and third impedance device (Z11) includes at least one of a resistive impedance device and a capacitive impedance device.

13. The lighting device with optical pulsation suppression by polyphase-driven electric energy as claimed in claim 11, wherein said direct current electric energy-driven luminous body (2000) includes at least one of a gas bulb with a filament, a solid state luminous body, and a light emitting diode.

* * * * *